US012173712B2

(12) United States Patent
Spada et al.

(10) Patent No.: US 12,173,712 B2
(45) Date of Patent: Dec. 24, 2024

(54) VACUUM PUMPING SYSTEM HAVING A PLURALITY OF POSITIVE DISPLACEMENT VACUUM PUMPS AND METHOD FOR OPERATING THE SAME

(71) Applicant: Agilent Technologies, Inc., Santa Clara, CA (US)

(72) Inventors: Christian Spada, Turin (IT); David Lukman, Concord (CA); Roberto Carboneri, Turin (IT); Andrea Bertallot, Cavour Torino (IT); Pascal Martin, Concord (CA)

(73) Assignee: Agilent Technologies, Inc., Santa Clara, CA (US)

( * ) Notice: Subject to any disclaimer, the term of this patent is extended or adjusted under 35 U.S.C. 154(b) by 57 days.

(21) Appl. No.: 17/334,598

(22) Filed: May 28, 2021

(65) Prior Publication Data

US 2021/0372405 A1 Dec. 2, 2021

(30) Foreign Application Priority Data

May 29, 2020 (EP) ..... 20177546

(51) Int. Cl.
*F04C 28/28* (2006.01)
*F04B 23/04* (2006.01)
(Continued)

(52) U.S. Cl.
CPC ..... *F04C 28/02* (2013.01); *F04B 23/04* (2013.01); *F04C 23/001* (2013.01); *F04C 25/02* (2013.01);
(Continued)

(58) Field of Classification Search
CPC ..... F04C 28/02; F04C 23/04; F04C 23/001; F04C 25/02; F04C 28/28; F04C 29/028;
(Continued)

(56) References Cited

U.S. PATENT DOCUMENTS 4,621,985 A 11/1986 Kobayashi et al.
6,056,510 A * 5/2000 Miura ..... F04B 37/14 417/19
(Continued)

FOREIGN PATENT DOCUMENTS

EP 1739308 A1 1/2007
EP 1906024 A2 4/2008
(Continued)

OTHER PUBLICATIONS

Extended European Search Report mailed on Nov. 25, 2020 for Application No. EP 20177546.7; 11 pages.

*Primary Examiner* — Connor J Tremarche

(57) ABSTRACT

A vacuum pumping system includes a plurality of positive displacement vacuum pumps, and more particularly a plurality of positive displacement vacuum pumps working in parallel. The vacuum pumping system includes a management unit that carries out a synchronized control of all the positive displacement vacuum pumps of the vacuum pumping system and thus allows to check possible risk of contamination of the vacuum pumping system and carry out, if needed, the necessary corrective actions without requiring any modification to the construction of the vacuum pumping system.

20 Claims, 8 Drawing Sheets

(51) Int. Cl.

| | |
|---|---|
| ***F04C 23/00*** | (2006.01) |
| ***F04C 25/02*** | (2006.01) |
| ***F04C 28/02*** | (2006.01) |
| ***F04C 29/02*** | (2006.01) |
| ***F04C 29/04*** | (2006.01) |
| *F04C 28/06* | (2006.01) |

(52) U.S. Cl.
CPC ..... *F04C 28/28* (2013.01); *F04C 29/028* (2013.01); *F04C 29/04* (2013.01); *F04C 28/06* (2013.01); *F04C 2220/10* (2013.01); *F04C 2220/30* (2013.01); *F04C 2240/20* (2013.01); *F04C 2270/052* (2013.01); *F04C 2270/09* (2013.01); *F04C 2270/10* (2013.01); *F04C 2270/18* (2013.01); *F04C 2270/19* (2013.01)

(58) Field of Classification Search
CPC ..... F04C 29/04; F04C 28/06; F04C 2210/10; F04C 2220/30; F04C 2240/20; F04C 2270/052; F04C 2270/09; F04C 2270/10; F04C 2270/18; F04C 2270/19
See application file for complete search history.

(56) References Cited

U.S. PATENT DOCUMENTS

| | | | | |
|---|---|---|---|---|
| 6,364,621 | B1 * | 4/2002 | Yamauchi | F04B 49/065 417/44.11 |
| 7,539,549 | B1 * | 5/2009 | Discenzo | G06N 3/08 702/183 |
| 2014/0363319 | A1 * | 12/2014 | Carboneri | F04C 29/045 417/372 |
| 2017/0207075 | A1 * | 7/2017 | Quarmby | H01J 49/0404 |
| 2018/0005812 | A1 * | 1/2018 | Mavanur | H01J 49/005 |
| 2018/0240660 | A1 * | 8/2018 | Fujito | H01J 49/025 |
| 2019/0055945 | A1 * | 2/2019 | Coeckelbergs | F04C 25/02 |

FOREIGN PATENT DOCUMENTS

| | | | |
|---|---|---|---|
| EP | 3392509 | B1 | 10/2019 |
| WO | 2006097679 | A1 | 9/2006 |
| WO | 2018100342 | A1 | 6/2018 |

* cited by examiner

VACUUM PUMPING SYSTEM HAVING A PLURALITY OF POSITIVE DISPLACEMENT VACUUM PUMPS AND METHOD FOR OPERATING THE SAME

RELATED APPLICATIONS

This application claims priority to EPO Application No. EP 20177546.7, filed May 29, 2020, the entire contents of which are incorporated herein by reference.

TECHNICAL FIELD

The present invention relates to a vacuum pumping system having a plurality of positive displacement vacuum pumps, and more particularly a plurality of positive displacement vacuum pumps working in parallel. The present invention also relates to a method for operating a vacuum pumping system having a plurality of positive displacement vacuum pumps, and more particularly a plurality of positive displacement vacuum pumps working in parallel and/or connected to vacuum chambers communicating with one another.

BACKGROUND

Vacuum pumps are used to achieve vacuum conditions, i.e. for evacuating a chamber (so-called "vacuum chamber") and establishing sub-atmospheric pressure conditions in said chamber. Many different kinds of vacuum pumps, having different structures and operating principles, are known and each time a specific vacuum pump is to be selected according to the needs of a specific application, namely according to the degree of vacuum that is to be attained in the corresponding vacuum chamber.

Positive displacement vacuum pumps displace gas from sealed areas to the atmosphere or to a downstream pumping stage.

Positive displacement pumps are very efficient and cost-effective in generating low vacuum conditions. For this reason, they may be used as main pumps in vacuum systems, but they often serve as fore pumps to other pumps, such as for instance turbomolecular pumps.

Unfortunately, under some circumstances, positive displacement vacuum pumps, such as rotary vane vacuum pumps or scroll pumps, may contaminate the vacuum system in which they are installed.

Rotary vane vacuum pumps can be considered by way of non-limiting example.

A vacuum pumping device 150 comprising a conventional rotary vane vacuum pump 110 and a motor 140 associated therewith is schematically shown in FIGS. 1 and 2.

As shown in FIGS. 1 and 2, a conventional rotary vane vacuum pump 110 generally comprises an outer housing 112, receiving a pump body 114 within which a stator surrounding and defining a cylindrical pumping chamber 116 is defined. The pumping chamber 116 accommodates a cylindrical rotor 118, which is eccentrically located with respect to the axis of the pumping chamber 116; one or more radially movable radial vanes 120 (two in the example shown in FIG. 2) are mounted on said rotor 118 and kept against the wall of the pumping chamber 116, for instance by means of springs 122.

During operation of the vacuum pump 110, gas flows from a vacuum chamber through an inlet port 124 of the pump and passes, through a suction duct 126, into the pumping chamber 116, where it is pushed and thus compressed by vanes 120, and then it is exhausted through an exhaust duct 128 ending at a corresponding outlet port 130.

A proper amount of oil is introduced from an oil tank (not shown) into the outer casing 112 for acting as coolant and lubricating fluid. In the example shown in FIG. 2, for instance, the inner casing 114 is immersed in an oil bath 132.

In order to drive the rotor 118 of the vacuum pump, the vacuum pumping device 150 further comprises a motor 140 and the pump rotor 118 is mounted to a rotation shaft which is driven by said motor.

As mentioned above, in rotary vane vacuum pumps oil is used for lubricating and cooling the pump moving parts. In this kind of pump oil also acts as a sealant for providing sealing between zones at different pressures.

The presence of oil vapors at the inlet of the vacuum pump entails the risk of backflow and contamination of the vacuum chamber that is being evacuated by the vacuum pump.

Such risk is much higher in vacuum pumping systems in which two or more rotary vane vacuum pumps work in parallel and/or connecting to vacuum chambers communicating with one another.

Indeed, in such complex vacuum pumping systems, if one of the rotary vane vacuum pumps stops due to a failure, the other rotary vane vacuum pump(s) of the vacuum pumping system can suck the oil vapors at the inlet of the vacuum pump that has stopped. Therefore, the sucked oil passes through the vacuum chamber(s) to which the vacuum pumps are connected and the final effect is that the vacuum pumping system is contaminated.

In order to prevent contamination of the vacuum chamber, a positive displacement vacuum pump, such as a rotary vane vacuum pump can be equipped, with protection devices so as to avoid pressure rises and/or oil backflow towards the vacuum chamber when the pump is switched off. In this way, the vacuum chamber can be completely isolated [form] from the positive displacement vacuum pump.

In case of a vacuum pumping system having a plurality of positive displacement vacuum pumps working in parallel, each positive displacement vacuum pump is equipped with its own protection device, such as an anti-backflow valve, which prevents backflow towards the vacuum chamber, thus suppressing the risk of contamination of the vacuum chamber.

When two or more positive displacement vacuum pumps are connected in parallel to the same vacuum chamber however, the anti-backflow valves fitted on each single pump may lose effectiveness under some particular operating conditions, so that the vacuum chamber becomes exposed to contamination.

In order to avoid the risk of contamination under all circumstances (both during normal operation conditions and fault conditions), it is possible to provide the vacuum pumping with external systems or devices. For instance, isolation valves could be provided for each positive displacement vacuum pump.

However, such solution is not attractive, since it increases the number of components and the complexity of the vacuum pumping system and involves additional costs.

In previous analytical instruments reliant upon vacuum pumping systems and operated by the Applicant (mass spectrometers), multiple vacuum pumps were in common fluid communication with a vacuum chamber of a vacuum pumping system, for instance through a T-connector in common communication with a vacuum port of the vacuum chamber. Contamination of these systems was not known to occur due to vacuum pump failure. The Applicant's recent development work has led to the need for vacuum pumps in separate communication with the vacuum chamber, such that the vacuum chamber forms a fluid path between the vacuum pumps. The inventors unexpectedly discovered a contamination issue with such a system, though the vacuum pumps were being operated in a conventional manner. Accordingly, the inventors identified a need for a system and method for operating a plurality of vacuum pumps in separate communication with a vacuum chamber that reduces a risk of contaminating the vacuum chamber.

An object of the present disclosure is to provide a vacuum pumping system in which the risk of contamination of the vacuum chamber is suppressed, while avoiding the introduction of additional external devices or system.

Another object of the present disclosure is to provide a method for operating a vacuum pumping system which allows to avoid the risk of contamination of the vacuum chamber without implementing any additional external devices or system.

These and other objects may be achieved by the vacuum pumping system and the method for operating a vacuum pumping system as disclosed herein.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

The inventors have discovered a potential for contamination of a vacuum chamber of a vacuum pumping system when two or more vacuum pumps are separately connected to the vacuum chamber, i.e. with separate vacuum ports in fluid communication with the vacuum chamber, each vacuum port separately connecting at least one vacuum pump to the vacuum chamber. Under certain pump operation conditions there is a potential for one vacuum pump of the vacuum pumping system to induce a backflow through another vacuum pump so as to draw contaminated gas into the vacuum chamber and accordingly contaminate the vacuum chamber.

The vacuum pumping system according to the invention comprises a plurality of positive displacement vacuum pumps, working in parallel, i.e. intended to be separately connected to the same vacuum chamber, and/or separately connected to vacuum pumping chambers which are in communication with one another.

The vacuum pumping system further comprises a management unit controlling in a synchronized manner all the positive displacement vacuum pumps of the vacuum pumping system. The synchronized manner adjusts operational parameters of the vacuum pumps to avoid conditions where one or more vacuum pumps may backflow into the common vacuum chamber.

More particularly this management unit is configured for:

- identifying one or more operating parameters related to a risk of contamination of the vacuum pumping system by a positive displacement vacuum pump;
- setting a threshold value or condition for each of said parameters;
- controlling all the positive displacement vacuum pumps of the vacuum pumping system by detecting the identified parameters for each pump and by comparing for each pump the current values or conditions of the identified parameters with the corresponding threshold values or conditions.

In embodiments, the management unit may be configured for:

- monitoring one or more operating parameters of each of the vacuum pumps of a parallel vacuum pumping system;
- identifying, from the monitoring, a condition wherein at least one of the pumps is operating at a threshold level, the threshold level indicative that the condition risks or indicates potential backflow from that pump or another pump of the vacuum pumping system; and,
- based on the identified condition, synchronizing operation of the vacuum pumps of the vacuum pumping system to prevent the backflow.

In some aspects, the synchronizing operation may comprise increasing an operational speed of one or more vacuum pumps that are under-pumping relative to the other one or more vacuum pumps. In some aspects, the synchronizing operation may comprise reducing an operational speed of one or more vacuum pumps that are over-pumping relative to the other one or more vacuum pumps. In some aspects, the one or more operational parameters comprises a measurement of pump speed/frequency.

This management unit is further configured for implementing corrective actions in a synchronized way on several positive displacement pumps of the vacuum pumping system (preferably, all said positive displacement vacuum pumps) in case the detected value of one or more identified parameter(s) exceeds the corresponding threshold value or the detected condition of one or more identified parameter(s) is not consistent with the corresponding threshold condition.

More particularly, the management unit is further configured for switching off in a synchronized way several positive displacement pumps of the vacuum pumping system (preferably, all said positive displacement vacuum pumps) in case the detected value of one or more identified parameter(s) exceeds the corresponding threshold value or the detected condition of one or more identified parameter(s) is not consistent with the corresponding threshold condition.

The management unit may be further configured for triggering an alarm in case the detected value of one or more identified parameter(s) exceeds the corresponding threshold value or the detected condition of one or more identified parameter(s) is not consistent with the corresponding threshold condition.

Advantageously, the invention provides for a synchronized management of several positive displacement vacuum pumps of the vacuum pumping system (preferably, all said positive displacement vacuum pumps), so that failure of a single vacuum pump is immediately taken into account by acting not only on the malfunctioning vacuum pump, but also on the other vacuum pumps of the vacuum pumping system, thus effectively preventing any risk of contamination of the vacuum pumping system itself.

The management unit could control all the positive displacement vacuum pumps of the vacuum pumping system simultaneously.

As an alternative, the management unit could control all the positive displacement vacuum pumps of the vacuum pumping system sequentially or according to a predetermined order.

The management unit could control the positive displacement vacuum pumps of the vacuum pumping system continuously.

As an alternative, the management unit could control the positive displacement vacuum pumps of the vacuum pumping system in a discrete manner, at predetermined time intervals.

Advantageously, the management unit of the vacuum pumping system according to the invention allows to check possible risk of contamination of the vacuum pumping system and carry out, if needed, the necessary corrective actions without requiring any modification to the construction of the vacuum pumping system, namely without requiring any additional components such as sensors, vacuum gauges, isolation valves and the like.

As is known, although positive displacement vacuum pumps may be directly connected to a vacuum chamber, they are more frequently used as backing pumps for a high-vacuum vacuum pump, such as a turbomolecular vacuum pump.

Accordingly, the vacuum pumping system according to the invention may further comprise one or more high-vacuum vacuum pumps (e.g. one or more turbomolecular pumps) and the management unit may be configured for controlling said high-vacuum vacuum pumps, with the aim of improving their working life.

For example, in case of a turbomolecular vacuum pump, by checking parameters such as power, frequency and temperature of the bearings it would be possible to predict a failure of the turbomolecular vacuum pump.

In addition, in case of failure of a positive displacement vacuum pump working as backing pump for a turbomolecular vacuum pump, the turbomolecular vacuum pump itself would work under critical conditions. In this scenario, the management unit, by checking the parameters of all the vacuum pumps of the vacuum pumping system in a synchronized way, would be able to immediately switch off the turbomolecular vacuum pump, thus avoiding damages and increasing working life.

In some embodiments of a vacuum pumping system, a management unit may be operative to initiate a start-up sequence that sequentially verifies operation of the vacuum pumps in a synchronized way to confirm identified operating parameters are maintained within an expected threshold or band (in other words, a threshold value or range of values) before increasing pumping speed to induce an operating vacuum in the vacuum chamber of the vacuum pumping system. In some aspects, the vacuum pumping system may include a plurality of groups of one or more vacuum pumps, each of the plurality of groups of one or more vacuum pumps in separate communication with a vacuum chamber of the vacuum pumping system. An anti-suckback valve may separate each of the groups of one or more vacuum pumps from the vacuum chamber. In operation, the management unit may be operative to activate a first group of one or more pumps to operate at a low start up level while the other group(s) of one or more pumps remain inactive. The inactive pumps do not apply suction to their respective backflow valves which results in the backflow valves remaining closed, preventing backflow. The management unit monitors one or more operating parameters of the first group of pumps to identify that the first group of pumps are operating as expected. After confirming expected operation of the first group of pumps, the management unit activates a next group of one or more pumps. The operating parameters of the next group of pumps are set to synchronize operation of the next group of pumps with the previously activated group of pumps to avoid a backflow condition when the backflow valve opens and places the first group of pumps in communication with the second group of pumps. In some aspects, additional groups of pumps may similarly be activated, monitored, and synchronized to avoid the backflow condition.

In some embodiments of a vacuum pumping system, a management unit may be operative to monitor operation of vacuum pumps to confirm their operation in a synchronized way by monitoring operating parameters of the pumps to confirm they are maintained within an expected threshold or band (a threshold value or range of values) for a given operational state. In some aspects, the vacuum pumping system may include a plurality of groups of one or more vacuum pumps, each of the plurality of groups of one or more vacuum pumps in separate communication with a vacuum chamber of the vacuum pumping system. An anti-suckback valve may separate each of the groups of one or more vacuum pumps from the vacuum chamber. In operation, the management unit may be operative to monitor one or more operating parameters of the pumps to identify that they are operating as expected. When the management unit detects that a pump is operating outside of expected conditions, for instance by detecting that an operational parameter of the pump meets or deviates from an expected threshold value, the management unit is operative to synchronize operation of the pumps to avoid operating conditions of the other pumps that will lead to backflow through one or more of the pumps of the system.

In some aspects, the vacuum chamber may comprise a plurality of vacuum chambers in communication, with at least two of the plurality of groups of pumps in communication with a separate one of the vacuum chambers. The vacuum chambers may be separated from one another, for instance, by a small orifice, relative to the size of the vacuum chambers. In some aspects, one of the vacuum chambers may further be in communication with atmosphere through an orifice. In these aspects, the vacuum chamber in communication with atmosphere is maintained at a higher pressure than the other vacuum chambers. Accordingly, in these aspects, a pressure differential is maintained between the vacuum chamber connected to the first group of pumps and the vacuum chamber connected to the other group of pumps.

Correspondingly, the method for operating a vacuum pumping system comprising a plurality of positive displacement vacuum pumps according to the invention comprises the steps of:

- identifying one or more operating parameters related to a contamination of the vacuum pumping system by a positive displacement vacuum pump;
- setting a threshold value or condition for each of said parameters;
- detecting the identified parameters for each positive displacement vacuum pump;
- comparing for each positive displacement vacuum pump the detected values or conditions of the identified parameters with the corresponding threshold values or conditions.

The method further comprises the step of implementing corrective actions in a synchronized way on several positive displacement pumps of the vacuum pumping system (preferably, all said positive displacement vacuum pumps) in case the detected value of one or more identified parameter(s) exceeds the corresponding threshold value or the detected condition of one or more identified parameter(s) is not consistent with the corresponding threshold condition.

More particularly, the method preferably comprises the step of switching off in a synchronized way several positive displacement pumps of the vacuum pumping system (preferably, all said positive displacement vacuum pumps) in case the detected value of one or more identified parameter(s) exceeds the corresponding threshold value or the detected condition of one or more identified parameter(s) is not consistent with the corresponding threshold condition.

Moreover, the method may further comprise the step of triggering an alarm in case the detected value of one or more identified parameter(s) exceeds the corresponding threshold value or the detected condition of one or more identified parameter(s) is not consistent with the corresponding threshold condition.

The detecting and comparing steps could be carried out simultaneously for all the positive displacement vacuum pumps of the vacuum pumping system.

As an alternative, the detecting and comparing steps could be carried out on the positive displacement vacuum pumps of the vacuum pumping system sequentially or according to a predetermined order.

The detecting and comparing steps could be carried out in a continuous manner.

As an alternative, the detecting and comparing steps could be carried out in a discrete manner, at predetermined time intervals.

In some embodiments, a vacuum pumping system is provided. The vacuum pumping system may include at least one mutually communicating vacuum chamber and a plurality of vacuum pumps each separately connected to the at least one vacuum chamber. A management unit may be configured to control operation of the plurality of vacuum pumps and to monitor one or more operating parameters of the plurality of vacuum pumps. Based on the monitoring the management unit may identify, based on the one or more operating parameters, a mismatch in expected pumping between the one or more of the plurality of vacuum pumps. In some aspects, of the vacuum pumping system at least one mutually communicating vacuum chamber comprises a plurality of mutually communicating vacuum chambers, and wherein one of the plurality of vacuum pumps is in separate communication with a first vacuum chamber of the plurality of vacuum chambers and the other of the plurality of vacuum pumps is in separate communication with the other of the plurality of vacuum chambers. In some aspects, at least one of the vacuum chambers is in communication with atmosphere. In some aspects, the management unit may be further operative to activate the plurality of vacuum pumps by: activating a first vacuum pump of the plurality of vacuum pumps, monitoring one or more operating parameters of the first vacuum pump, confirming from the monitoring, that the first vacuum pump is providing expected pumping, such as by operating within an expected pump speed range, and, based on the confirming, activating a second vacuum pump of the plurality of vacuum pumps; monitoring one or more operating parameters of the first vacuum pump and the second vacuum pump while synchronizing operation of the first vacuum pump and the second vacuum pump to match the expected pump speed of the first vacuum pump and the expected pump speed of the second vacuum pump to prevent backflow from one of the plurality of vacuum pumps into the at least one mutually communicating vacuum chamber.

In the embodiments of vacuum pumping systems or methods described above the one or more operating parameters may, in some embodiments, be selected from the group including: pump speed or frequency, power, current, voltage, and temperature(s) of pump component(s).

According to another embodiment, a mass spectrometry (MS) system includes: a first vacuum chamber for containing a first ion guide configured to receive a plurality of ions generated by an ion source; a first positive displacement pump configured to maintain the first vacuum chamber at a first operating pressure; a second vacuum chamber for containing a second ion guide configured to receive at least a portion of the ions transmitted from the first ion guide, wherein the second vacuum chamber is fluidly coupled to the first vacuum chamber; a second positive displacement pump configured to maintain the second vacuum chamber at a second operating pressure that is lower than the first operating pressure; and a controller, operably connected to the first and second positive displacement pumps, wherein the controller is configured to: monitor one or more operating parameters of the first and second positive displacement pumps; and identify, based on the one or more operating parameters, a mismatch in expected pumping between the first and second positive displacement vacuum pumps.

In an embodiment, the controller is further configured to: identify one or more operating parameters of the first and second positive displacement vacuum pumps related to a risk of contamination of the first and second vacuum chambers by one or more of the first and second positive displacement vacuum pumps; set a threshold value or condition for each of the identified operating parameters; detect the identified operating parameters for each of the first and second positive displacement vacuum pumps; compare, for each of the first and second positive displacement vacuum pumps, the detected values or conditions of the identified parameters with the corresponding threshold values or conditions; and if the detected value of one or more identified operating parameter(s) of one of the first and second positive displacement vacuum pumps exceeds the corresponding threshold value or the detected condition of one or more identified operating parameter(s) of one of the first and second positive displacement vacuum pumps is not consistent with the corresponding threshold condition, acting in a synchronized way on the other of the first and second positive displacement vacuum pumps.

In an embodiment, the second vacuum chamber is fluidly coupled to the first vacuum chamber via an aperture in an exit lens of the first vacuum chamber.

In an embodiment, the second positive displacement pump is further configured to back a first turbomolecular pump for maintaining a third vacuum chamber at a third operating pressure that is lower than the second operating pressure, the third vacuum chamber for containing at least a third ion guide.

In an embodiment, the second positive displacement pump is further configured to back a second turbomolecular pump for maintaining a fourth vacuum chamber at a fourth operating pressure that is lower than the third operating pressure, the fourth vacuum chamber for containing at least one mass analyzer.

In an embodiment, the first operating pressure is in a range from about 1 Torr to about 100 Torr, and optionally, wherein the second operating pressure is in a range from about 500 mTorr to about 5 Torr, and further optionally, wherein the third operating pressure is less than about 100 mTorr, and further optionally, wherein the fourth operating pressure is less than about $1\times10^{-4}$ Torr.

According to another embodiment, a method of operating a vacuum system for a mass spectrometry (MS) system includes: monitoring one or more operating parameters of a first positive displacement pump configured to maintain a first vacuum chamber at a first operating pressure, wherein the first vacuum chamber contains a first ion guide configured to receive a plurality of ions generated by an ion source; monitoring one or more operating parameters of a second positive displacement pump configured to maintain a second vacuum chamber at a second operating pressure, wherein the second vacuum chamber contains a second ion guide configured to receive at least a portion of the ions transmitted from the first ion guide; and identifying, based on the one or more operating parameters of the first and second positive displacement pumps, a mismatch in expected pumping between the first and second positive displacement vacuum pumps.

In an embodiment, the method further includes: identifying the one or more operating parameters of the first and second positive displacement vacuum pumps related to a risk of contamination of the first and second vacuum chambers by one or more of the first and second positive displacement vacuum pumps; setting a threshold value or condition for each of the identified parameters; detecting the identified parameters for each of the first and second positive displacement vacuum pumps; comparing, for each of the first and second positive displacement vacuum pumps, the detected values or conditions of the identified parameters with the corresponding threshold values or conditions; and if the detected value of one or more identified parameter(s) of one of the first and second positive displacement vacuum pumps exceeds the corresponding threshold value or the detected condition of one or more identified parameter(s) of one of the first and second positive displacement vacuum pumps is not consistent with the corresponding threshold condition, acting in a synchronized way on the other of the first and second positive displacement vacuum pumps.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

The invention can be advantageously applied to vacuum pumping systems including two or more positive displacement pumps working in parallel and/or connected to vacuum chambers which are mutually communicating.

Figure 3A:
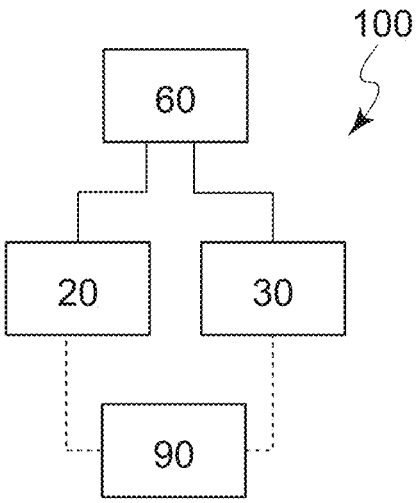
FIG. 3*a* is a schematic view of a construction of a vacuum pumping system according to an embodiment of the present disclosure.
Figure 3B:
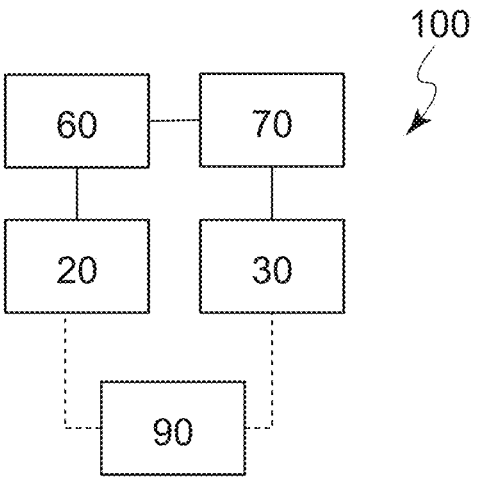
FIG. 3*b* is a schematic view of a construction of a vacuum pumping system according to another embodiment of the present disclosure.
Figure 3C:
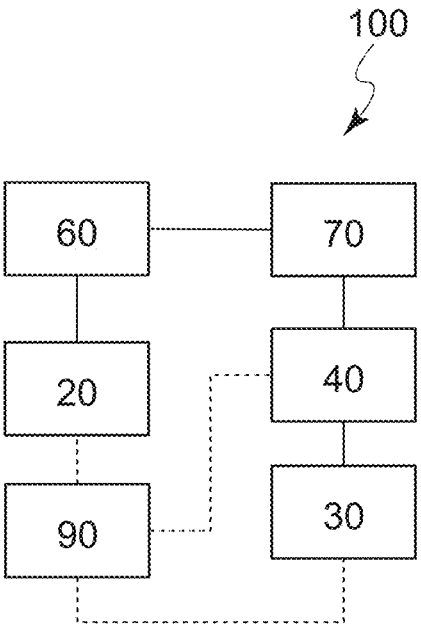
FIG. 3*c* is a schematic view of a construction of a vacuum pumping system according to another embodiment of the present disclosure.

FIGS. 3*a*-3*c* show some exemplary, non-limiting examples of constructions of such vacuum pumping system 100.

Nevertheless, it shall be understood that the invention could be applied to vacuum pumping systems comprising a plurality of positive displacement vacuum pumps of any kind and structure, and possibly further comprising one or more high-vacuum vacuum pumps of any kind and structure.

FIG. 3*a* shows a first exemplary embodiment of the vacuum pumping system 100 of the invention, in which two positive displacement vacuum pumps 20, 30 are separately connected to a same vacuum chamber 60, i.e. they work in parallel but are connected to the vacuum chamber 60 through separate vacuum ports. In FIG. 3*a*, the vacuum chamber 60 forms a fluid connection between the vacuum pumps 20, 30.

FIG. 3*b* shows a second exemplary embodiment of the vacuum pumping system 100 of the invention, in which a first positive displacement vacuum pump 20 is connected to a first vacuum chamber 60, and a second positive displacement vacuum pump 30 is connected to a second vacuum chamber 70, the vacuum chambers 60, 70 being in fluid communication with each other. Similar to FIG. 3*a*, the vacuum chambers 60, 70 form a fluid connection between the vacuum pumps 20, 30.

FIG. 3*c* shows a third exemplary embodiment of the vacuum pumping system 100 of the invention, in which a first positive displacement vacuum pump 20 is connected to a first vacuum chamber 60 and a second positive displacement vacuum pump 30 works as a backing pump for a high-vacuum vacuum pump 40 (e.g. a turbomolecular vacuum pump), which in turn is connected to a second vacuum chamber 70, the vacuum chambers 60, 70 being in fluid communication with each other. Similar to FIG. 3*a*, the vacuum chambers 60, 70 and high-vacuum vacuum pump 40 form a fluid connection between the vacuum pumps 20, 30.

Figure 1:
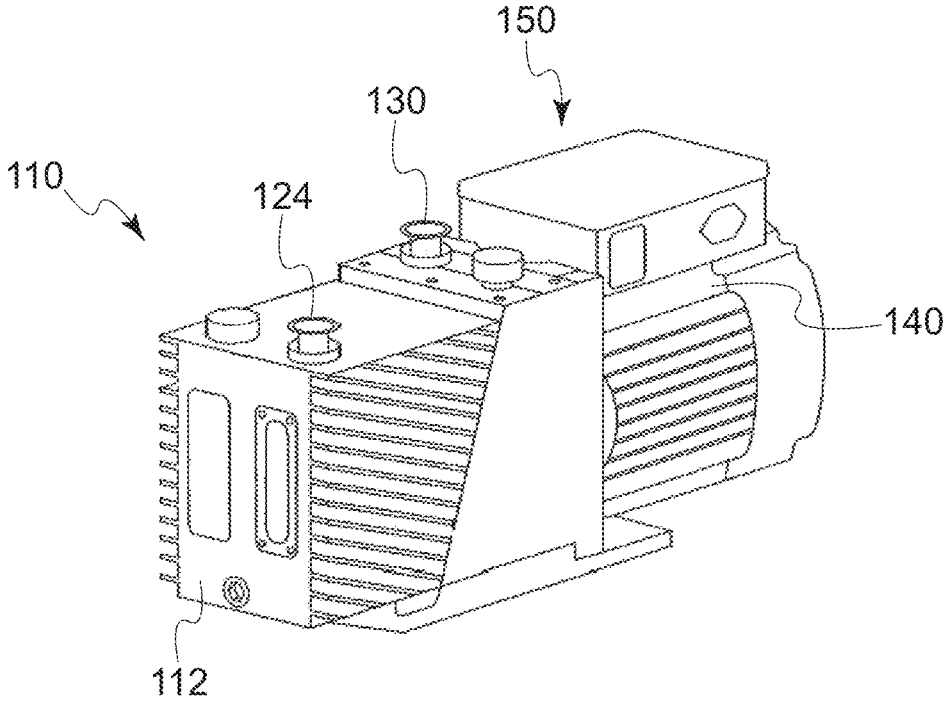
Fig. 1 (PRIOR ART)
FIG. 1 is a longitudinal sectional view of part of a vacuum pump of the prior art.
Figure 2:
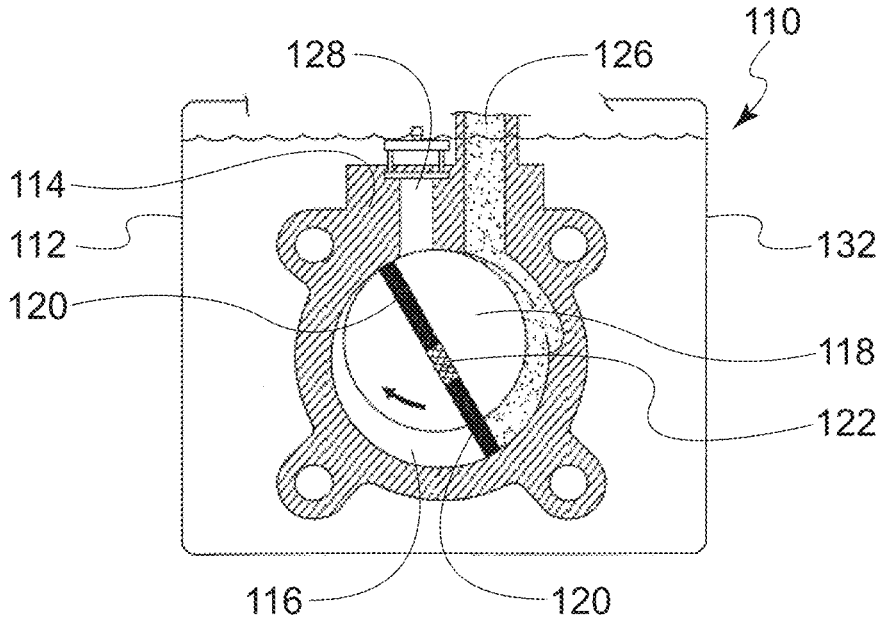
Fig. 2 (PRIOR ART)
FIG. 2 is a cross-sectional view, similar to FIG. 1, of part of a vacuum pump of the prior art.

In the exemplary vacuum pumping systems of FIGS. 3*a*-3*c*, the first and second positive displacement vacuum pumps can be oil lubricated pumps, such as, for instance, first and second rotary vane vacuum pumps, having an overall structure such as shown in FIGS. 1 and 2. Nevertheless, positive displacement vacuum pumps having a different structure and operation could be chosen as the first and second positive displacement pumps in the vacuum pumping system 100. More particularly, different types of vacuum pumps could be selected as the first and second positive displacement pumps in the vacuum pumping system 100. For instance, one of the positive displacement vacuum pumps could be an oil lubricated pump such as rotary vane vacuum pump, having an overall structure such as shown in FIGS. 1 and 2, while the other one could be a positive displacement vacuum pump having a different structure.

It will be evident to the person skilled in the art that, in all the shown embodiments, a failure of one of the first and second rotary vacuum pumps 20, 30 involves a risk of contamination of the vacuum pumping system.

In all the shown constructions, if, for instance, when starting the vacuum pumping system, the first rotary vane vacuum pump 20 is stopped due to a failure and the second rotary vane vacuum pump 30 is switched ON, the oil vapors at the inlet of first rotary vane vacuum pump 20 will be pumped by the second rotary vane vacuum pump 30 and sucked into the vacuum chamber 60 or vacuum chambers 60, 70, thus contaminating the vacuum pumping system.

In some arrangements, an anti-suckback valve may be introduced between the vacuum pumps 20, 30 and the vacuum chambers 60, 70. The anti-suckback valve is operative to close when the vacuum pumps 20, 30 are inactive to prevent backflow into the vacuum chambers 60, 70. Upon activation of the vacuum pumps 20, 30, the anti-suckback valves open under the vacuum created by the vacuum pumps 20,30. The inventors have determined that in some operating conditions, the anti-suckback valves may open under activation of their associated pump 20, 30 but under certain flow conditions in the vacuum chambers 60, 70 may induce backflow from the pump 20, 30 into the vacuum chambers 60, 70. These operating conditions are typically likely to be present during uncoordinated startup of the vacuum pumps 20, 30, defective operation of the vacuum pumps 20, 30, or uncoordinated shutdown of the vacuum pumps 20, 30. Backflow from the pumps 20, 30 into the vacuum chambers 60, 70 may lead to contamination and inaccurate measurement by an analytical instrument operating within the vacuum system 100.

In some embodiments, one of the vacuum chambers 60, 70 of the vacuum system 100 may be in communication with atmosphere, such as through an aperture. In these embodiments, the vacuum chambers 60, 70 are maintained at different operating pressures during operation and fluid is continually drawn through the aperture by operation of the vacuum pumps 20, 30. Unsynchronized operation of the vacuum pumps 20, 30 when working on these embodiments has been found to create unexpected flow conditions that may lead to backflow from one or more of vacuum pumps 20, 30 into the vacuum chambers 60, 70.

In all the exemplary embodiments shown in FIGS. 3*a*-3*c* and described above, the vacuum pumping system 100 further comprises a management unit 90 (or controller, or computer system).

The management unit 90 is configured to control both the rotary vane vacuum pumps 20, 30 in a synchronized manner. By controlling the vacuum pumps 20, 30 in a synchronized manner a backflow condition from at least one of the vacuum pumps 20, 30 into the vacuum chamber 60, 70 is avoided.

In detail, the management unit 90 is intended to check whether a possible risk of contamination arises and, in the affirmative, to carry out the necessary corrective actions for avoiding that such contamination takes place.

To this purpose, the management unit 90:

identifies one or more operating parameters related to a contamination of the vacuum pumping system by a positive displacement vacuum pump;

sets a threshold value or condition for each of said parameters;

detects the identified parameters for each positive displacement vacuum pump 20, 30;

compares for each positive displacement vacuum pump 20, 30 the current values or conditions of the identified parameters with the corresponding threshold values or conditions;

implements corrective actions in a synchronized way on both the positive displacement vacuum pumps 20, 30 in case the detected value of one or more identified parameter(s) of one or more of the positive displacement vacuum pumps exceeds the corresponding threshold value or the detected condition of one or more identified parameter(s) is not consistent with the corresponding threshold condition.

Preferably, the management unit 90 switches off in a synchronized way both the positive displacement vacuum pumps 20, 30 in case the detected value of one or more identified parameter(s) of one or more of the positive displacement vacuum pumps exceeds the corresponding threshold value or the detected condition of one or more identified parameter(s) is not consistent with the corresponding threshold condition.

Preferably, the management unit 90 further triggers an alarm in case the detected value of one or more identified parameter(s) of one or more the positive displacement vacuum pumps exceeds the corresponding threshold value or the detected condition of one or more identified parameter(s) is not consistent with the corresponding threshold condition.

By acting in a synchronized way on the positive displacement pumps of the vacuum pumping system, and preferably on all the positive displacement pumps of the vacuum pumping system, the management unit 90 of the vacuum pumping system according to the invention allows to effectively prevent any risk of contamination due to operation of a positive displacement vacuum pump after a failure of another positive displacement vacuum pump of the vacuum pumping system or to slow and deactivate a positive displacement vacuum pump in a synchronized way with the slowing and deactivation of a malfunctioning pump or a pump operating outside of its expected operational parameters.

And this result is achieved by the invention without the need of introducing any additional safety components.

With reference to the exemplary construction of FIG. 3*c*, the management unit 90 may be further configured to control the turbomolecular vacuum pump 40, as well.

More particularly, the management unit 90 may be further configured to implement corrective actions on the turbomolecular vacuum pump 40 in case the detected value of one or more identified parameter(s) of one or more of the positive displacement vacuum pumps exceeds the corresponding threshold value or the detected condition of one or more identified parameter(s) is not consistent with the corresponding threshold condition.

For instance, the management unit 90 may be further configured to switch off the turbomolecular vacuum pump 40 in case the detected value of one or more identified parameter(s) of one or more of the positive displacement vacuum pumps exceeds the corresponding threshold value or the detected condition of one or more identified parameter(s) is not consistent with the corresponding threshold condition.

FIG. 4-7 are flow charts which show, by way of non-limiting example, the operation of the management unit 90 of the vacuum pumping system according to the invention in possible operative conditions of the vacuum pumping system itself.

In FIGS. 4-7 operation of the management unit of a vacuum pumping system having a construction according to FIG. 3*a* is shown. Nevertheless, similar flow charts could be drafted for vacuum pumping system having different constructions, such as those shown in FIGS. 3*b* and 3*c*.

Figure 4:
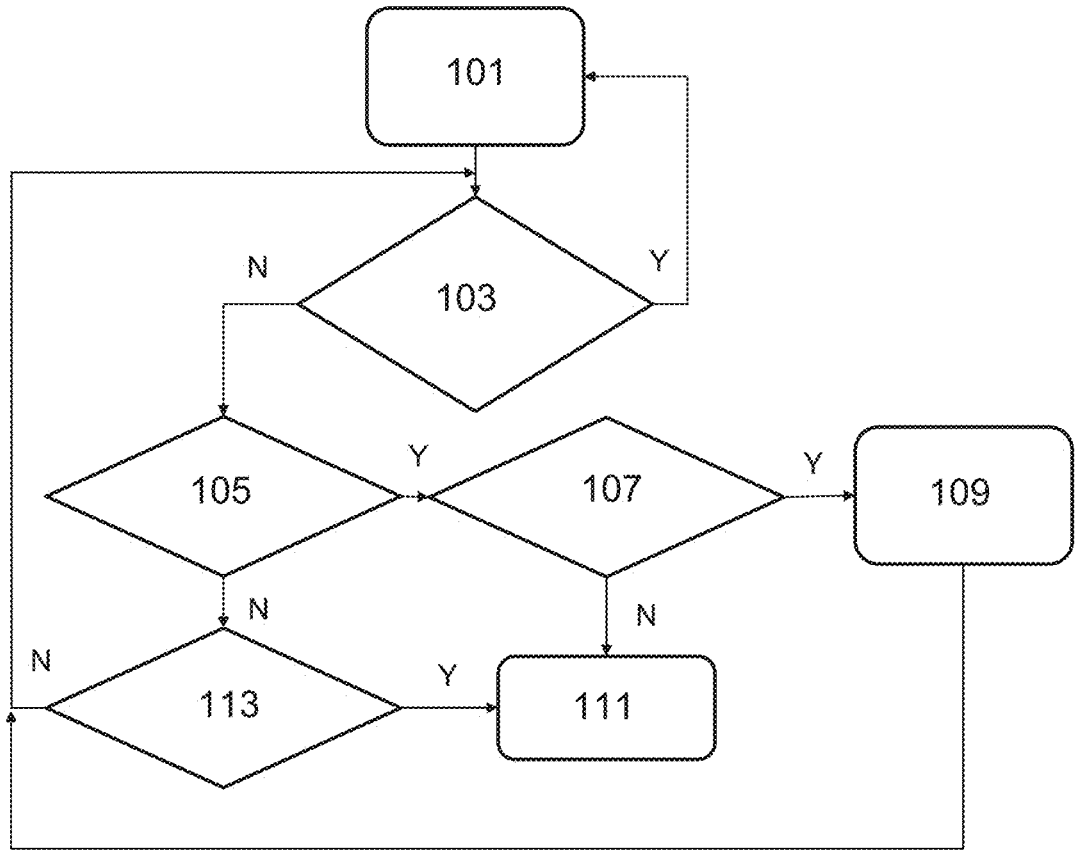
FIG. 4 is a flow chart showing the operation of the management unit of a vacuum pumping system according to the invention in a first operative condition.
Figure 5:
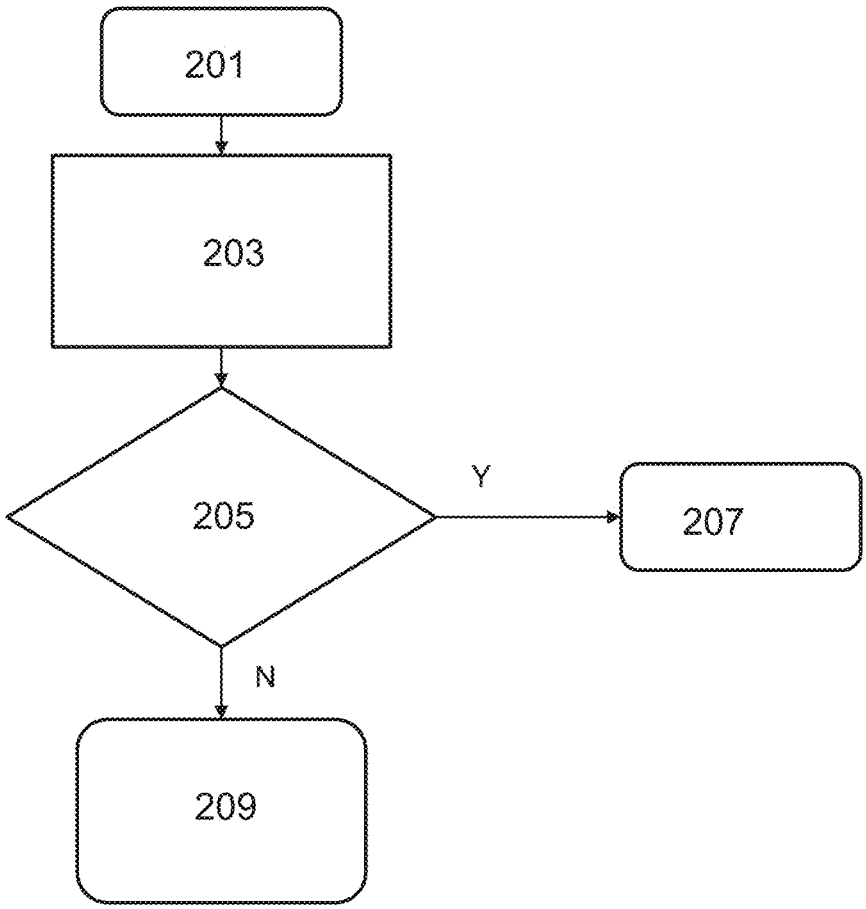
FIG. 5 is a flow chart showing the operation of the management unit of a vacuum pumping system according to the invention in a second operative condition.
Figure 6:
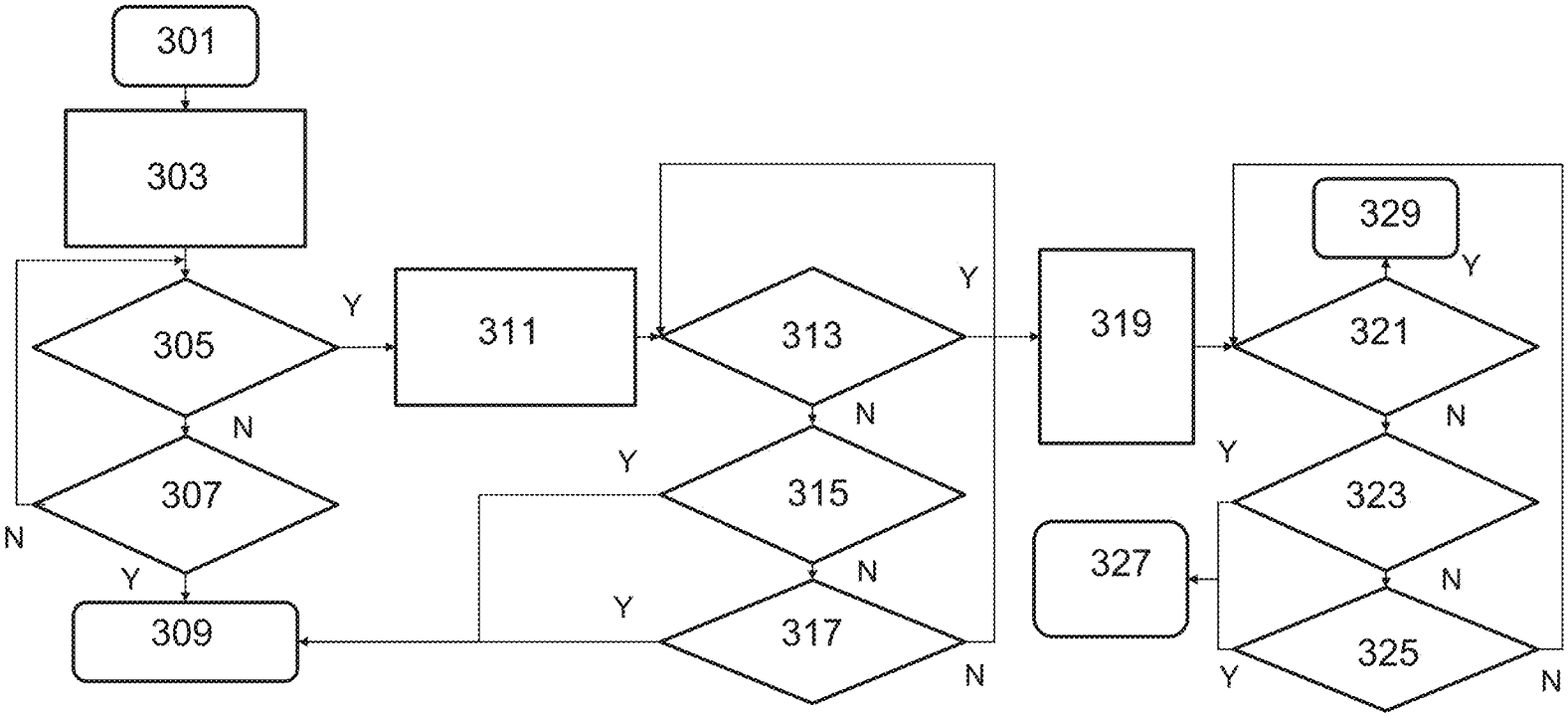
FIG. 6 is a flow chart showing the operation of the management unit of a vacuum pumping system according to the invention in a third operative condition.

In the flow charts of FIGS. 4-6, pump frequency is mainly used as parameter for controlling the operation of the positive vacuum pumps 20, 30 of the vacuum pumping system. An operating frequency of a pump 20, 30, corresponding to a desired pressure within the vacuum chambers 60, 70 is selected. When the system includes a plurality of vacuum pumps 20, 30 in separate communication with the vacuum chambers 60, 70, then the pressure in each of the vacuum chambers 60, 70 depends upon the vacuum pumps 20, 30 each operating at the selected operating frequency for that pump 20, 30. Accordingly, monitoring the pump frequency is a useful parameter for synchronizing the pumps 20, 30 to achieve desired pressure ranges in each of the vacuum chambers 60, 70.

However, it is evident that this choice has not to be understood as limiting: positive displacement vacuum pumps are complex devices in which different operating parameters are strongly correlated such as power, current, voltage absorbed (or used, or drawn, or consumed) by the pump, temperatures of pump components, and so on; any of these and other parameters can be used as a control parameter. In some embodiments, the operating parameter may comprise measurement of the environment of the vacuum pumping system, such as a pressure of each of the vacuum chambers 60, 70, a flow rate through the connections between the pumps 20,30 and the vacuum chambers 60,70, or some combination of such factors. Moreover, in more complex control algorithms, several parameters may be used to check the operation of the positive displacement vacuum pumps.

FIG. 4 shows, by way of non-limiting example the operation of the management unit 90 in a first operative condition of the vacuum pumping system, corresponding to normal operation conditions of the vacuum pumping system 100.

Under this operative condition, the rotary vane vacuum pumps 20, 30 run at nominal frequency, the pressure(s) in the vacuum chamber(s) 60,70 match the expected operating pressure(s), and the flow into each of the vacuum pumps 20,30 matches the expected flows.

The management unit 90 identifies two parameters related to a possible risk of contamination of the vacuum pumping system:

first parameter: failure of a rotary vane vacuum pump;

second parameter: pump frequency of a rotary vane vacuum pump.

The first parameter can assume two conditions, i.e. YES or NO. The management unit 90 sets NO as a condition in which there is no risk of contamination and YES as a condition in which a risk of contamination arises.

The second parameter can assume a range of values and the management unit 90 sets a threshold minimum value, below which a risk of contamination arises.

Therefore, the operation of the management unit 90 under this first operative condition is as follows:

rotary vane vacuum pumps 20, 30 run at nominal frequency (step 101);

the management unit 90 checks the actual frequency of the pumps 20, 30 and, for each pump, compares the actual frequency to the nominal frequency (step 103);

if the actual frequency is equal to the nominal frequency, no corrective action is implemented and a new control cycle is initiated;

if not, the management unit checks, for each pump, if the pump is derating (step 105);

if either of the pumps is derating, the management unit 90 further detects the pump frequency of each pump 20, 30 and compares the detected frequency with the minimum threshold value (step 107);

if the detected frequency for both pumps 20, 30 is higher than the minimum threshold value, the management unit 90 triggers an alarm, indicating that the pump frequency of one of the pumps is different from the nominal frequency (step 109);

if the detected frequency for one of the pumps 20, 30 is lower than the minimum threshold value, the management unit 90 detects a dangerous situation and triggers a synchronized shut-down procedure of both the pumps 20,30 (step 111);

if none of the pumps is derating, the management unit 90 further checks if one of the pumps is in fail (step 113);

if either of the pumps is in fail, the management unit 90 detects a dangerous situation and triggers a synchronized shut-down procedure of both the pumps 20,30 (step 111);

if none of the pumps is in fail no corrective action is implemented and a new control cycle is initiated.

The above control cycle can be carried out continuously or at predetermined time intervals.

FIG. 5 shows, by way of non-limiting example, the operation of the management unit 90 in a second operative condition of the vacuum pumping system, corresponding to vent phase at shutdown.

Under this operative condition, the rotary vane vacuum pumps 20, 30 will normally stop and the anti-suckback valve (ASBV) will close. This ensures that the vacuum system is not contaminated unless the ASBV malfunctions. Therefore, risk of contamination during the vent phase is relatively low.

In this condition, the management unit 90 identifies a single parameter related to a possible risk of contamination of the vacuum pumping system, i.e. the rotary vacuum pump is still running.

This parameter can assume two conditions, i.e. YES or NO. The management unit 90 sets NO as a condition in which there is no risk of contamination and YES as a condition in which a risk of contamination arises.

Therefore, the operation of the management unit 90 under this second operative condition is as follows:

the vent phase is initiated (step 201);

rotary vane vacuum pumps 20, 30 are simultaneously switched off (step 203);

the management unit 90 checks, for each pump, if the pump has stopped (step 205);

if both the pumps 20, 30 have stopped, the management unit does not implement any corrective action and the vacuum pumping system is brought to air, e.g atmospheric pressure (step 207);

if not, the management unit 90 triggers an alarm, for indicating to the operator that either or both vacuum pumps 20, 30 have to be manually switched off (step 209).

FIG. 6 is a flow chart showing the operation of the management unit 90 in a third operative condition of the vacuum pumping system, corresponding to starting of the vacuum pumping system.

The starting phase is the most critical phase in view of risks of vacuum pumping system contamination, because at atmospheric pressure the ASBV for pumps 20, 30 are open.

If during the starting phase, one of the pumps 20, 30 achieves the target frequency while the other pump 30, 20 for any reason is stopped, then the running pump is able to suck the oil vapours from the other pump 20 through the vacuum chamber 60. The final effect is the vacuum pumping system is contaminated.

During the starting phase, the pumps are started at their minimum frequency and gradual ramps up to the nominal frequency are performed. During these ramps, the differences in terms of pumping speed of the pumps connected to the same vacuum chamber have to be kept at a minimum. In embodiments where different sized or model pumps are employed the pumping speed of each pump may be different in synchronized operation, however their effective pumping on the vacuum is matched to avoid one pump drawing a backflow through another pump. The pumping speed or effective pumping of a pump may be reflected by one or more operating parameters including, for instance, the pump frequency, power draw, etc.

In this condition, the management unit 90 identifies two parameters related to a possible risk of contamination of the vacuum pumping system:

first parameter: failure of a rotary vane vacuum pump;

second parameter: difference between the pump frequency of the first rotary vane vacuum pump 20 and the pump frequency of the second rotary vane vacuum pump 30 at a certain delay after the rotary vane vacuum pumps have been turned on.

The management unit 90 sets a maximum threshold value for the aforesaid difference in pump frequency.

Therefore, the operation of the management unit 90 under this third operative condition is as follows:

the starting phase is initiated (step 301);

the frequency of the rotary vane vacuum pumps 20, 30 is brought to a first check value (step 303);

the management unit checks whether both pumps have reached the first check value after a first predetermined time interval, i.e. if the difference between the frequencies of the pumps is within a set threshold (step 305);

if not, the management unit checks whether either of the pumps is in fail (step 307); if yes, the management unit switches off both the pumps 20, 30 (step 309); if not the frequency ramp of the pumps is continued and a new check is carried out;

if yes (both pumps have reached the first check value after the first predetermined time interval), the frequency ramps go on and both pumps are brought to a second check value (step 311);

the management unit checks whether both the pumps have reached the second check value after a second predetermined time interval, i.e. if the difference between the frequencies of the pumps is within a set threshold (step 313);

if not, the management unit checks whether either of the pumps is in fail (step 315) and further checks whether the frequency of either of the pumps has dropped under the first check value (step 317); if one of these conditions is met, the management unit switches off both the pumps 20, 30 (step 309); if none of these conditions is met, the frequency ramp of the pumps is continued and a new check is carried out;

if yes (both the pumps have reached the second check value after the second predetermined time interval), the frequency ramps go on and both pumps are brought to a final check value, corresponding to the nominal frequency (step 319);

the management unit checks whether both the pumps have reached the final check value after a third predetermined time interval, i.e. if the difference between the frequencies of the pumps is within a set threshold (step 321);

if not, the management unit checks whether either of the pumps is in fail (step 323) and further checks whether the frequency of either of the pumps has dropped under the second check value (step 325); if one of these conditions is met, the management unit switches off both the pumps 20, 30 (step 327); if none of these conditions is met, the frequency ramp of the pumps is continued and a new check is carried out;

if yes (both the pumps have reached the final check value after the third predetermined time interval), the normal operation of the vacuum pumping system is reached (step 329).

Figure 7:
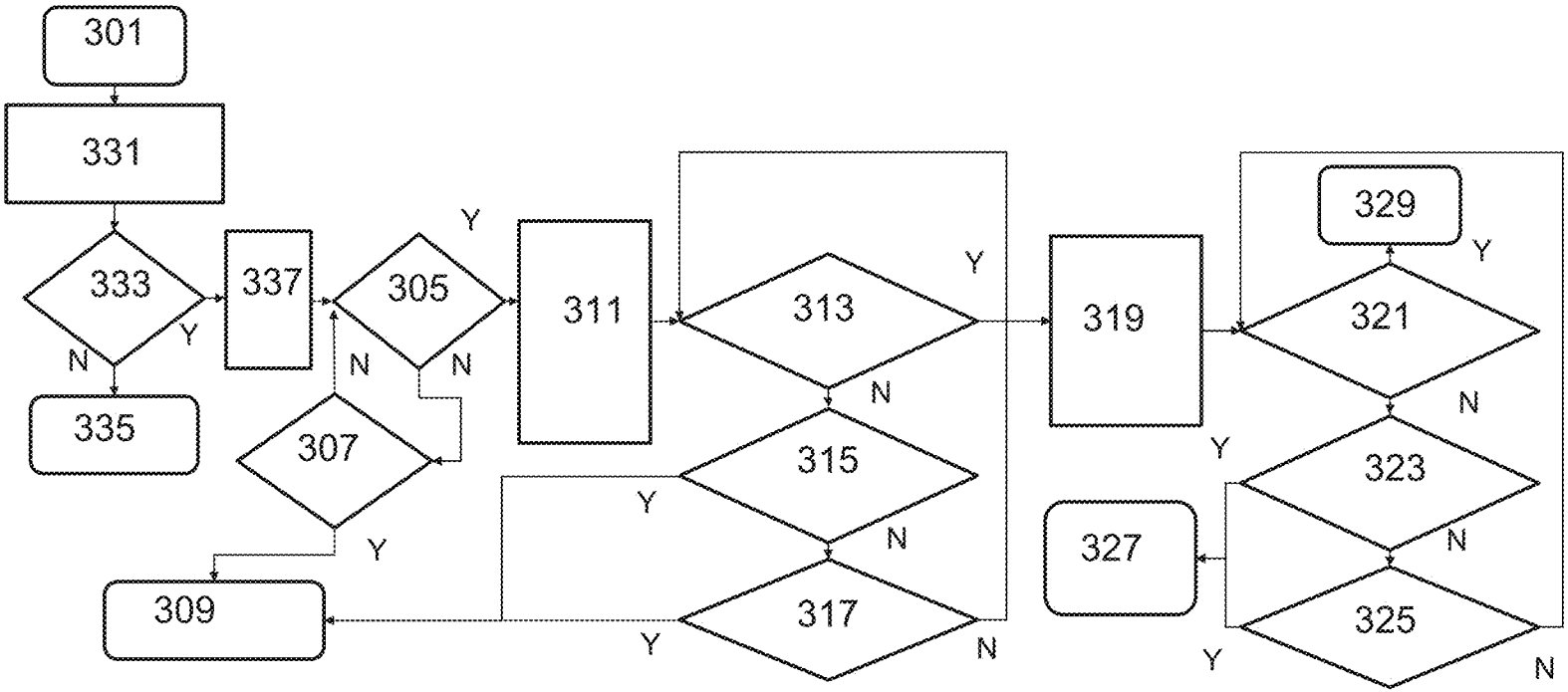
FIG. 7 is a flow chart showing the operation of the management unit of a vacuum pumping system according to a variant of the invention in the third operative condition.

FIG. 7 is a flow chart showing the operation of the management unit 90 in the same operative condition of FIG. 6, but applied to a vacuum pumping system including two rotary vane vacuum pumps having remarkably different sizes.

In this case, only the smaller pump is started at first, and the larger pump is started at a later stage.

Therefore, the flow chart of FIG. 7 differs from the flow chart of FIG. 6 in that it initially comprises the following steps:

the frequency of a first rotary vane vacuum pump 20 is brought to a first check value (step 331);

the management unit checks whether the first pump has reached the first check value after a first predetermined time interval (step 333);

if not, the pump is switched off (step 335);

if yes, the frequency of the second rotary vane vacuum pump 30 is brought to the first check value (step 337).

Then, the operation of the management unit is the same as described with reference to FIG. 6.

It will be evident to the person skilled in the art that the above description has been given by way of non-limiting example only, and many variants and modifications are possible without departing from the scope of the invention as defined in the following claims. Furthermore, the foregoing description is for the purpose of illustration only, and not for the purpose of limitation—the invention being defined by the claims.

For instance, it will be evident that many other operating conditions of the vacuum pumping system and corresponding parameters related to possible risk of contamination can be taken into account.

Moreover, although reference has been made to rotary vane vacuum pumps in the description of certain embodiments of the invention, it will be evident that the invention could be applied to a wide variety of vacuum pumping systems having a plurality of positive displacement vacuum pumps.

By way of example, the invention could be applied to a vacuum pumping system having a plurality of scroll vacuum pumps.

In this case, the risk of contamination would be connected to dust possibly present at the inlet of a scroll vacuum pump:

if one of the scroll vacuum pumps stops due to a failure, the other vacuum pump(s) of the vacuum pumping system could suck the dust at the inlet of the scroll vacuum pump that has stopped; therefore, the sucked dust would pass through the vacuum chamber(s) to which the vacuum pumps are connected and the final effect is that the vacuum pumping system is contaminated.

Figure 8:
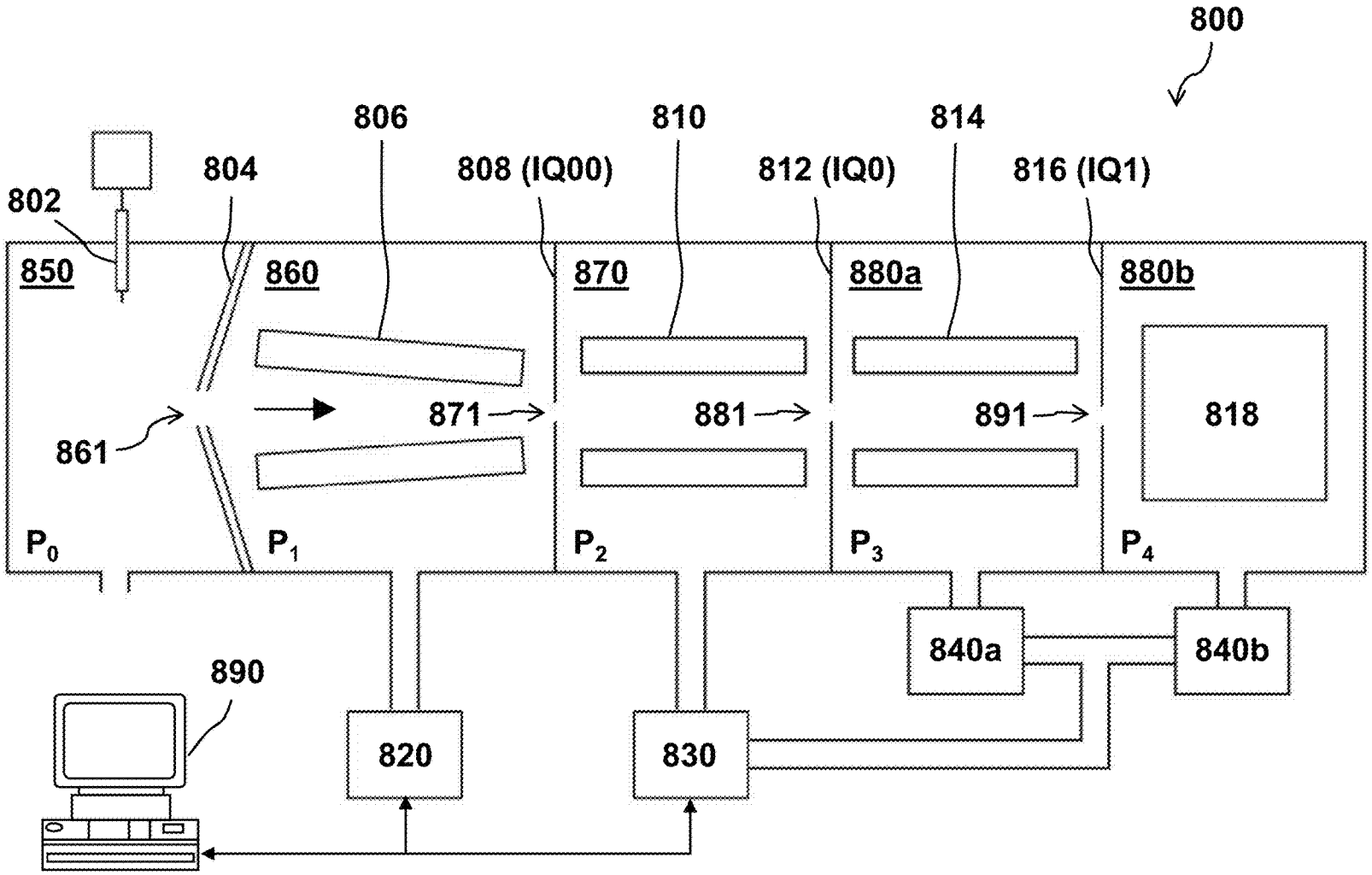
FIG. 8 is a schematic representation of an implementation of a vacuum pumping system according to various aspects of the present disclosure in an exemplary mass spectrometer system.

With reference now to FIG. 8, an example mass spectrometer (MS) system 800 implementing a vacuum pumping system in accordance with various aspects of the present teachings is schematically depicted. As shown in FIG. 8, the example mass spectrometer system 800 generally comprises an ion source 802 for generating ions within an ionization chamber 850, which are then transmitted in the general direction indicated by the arrow through various differentially-pumped vacuum chambers 860, 870, and 880*a,b* containing one or more ion guides (e.g., ion guide 806, ion guide 810, ion guide 814, mass spectrometer 818) for processing, mass analyzing, and/or detecting the ions. A management unit 890, which is operably connected to a vacuum pumping system comprising one or more positive displacement vacuum pumps 820, 830 and one or more turbomolecular pumps 840*a,b*, is configured to maintain the various chambers at various operating pressures as otherwise discussed herein.

The ion source 802 can be any known or hereafter developed ion source for generating ions and modified in accordance with the present teachings. Non-limiting examples of ion sources suitable for use with the present teachings include an atmospheric pressure chemical ionization (APCI) source, an electrospray ionization (ESI) source, a continuous ion source, a pulsed ion source, an inductively-coupled plasma (ICP) ion source, a matrix-assisted laser desorption/ionization (MALDI) ion source, a glow discharge ion source, an electron impact (EI) ion source, a chemical ionization (CI) source, or a photo-ionization (PI) ion source, among others. Additionally, as shown in FIG. 8, the system 800 can include a sample source configured to provide a sample to the ion source 802. The sample source can be any suitable sample inlet system known in the art. By way of example, the ion source 802 can be configured to receive a fluid sample from a variety of sample sources, including a reservoir containing a fluid sample that is delivered to the sample source (e.g., pumped), a liquid chromatography (LC) column, a capillary electrophoresis (CE) device, and via an injection of a sample into a carrier liquid. In the example depicted in FIG. 8, the ion source 802 comprises an electrospray electrode, which can comprise a capillary fluidly coupled to the sample source (e.g., through one or more conduits, channels, tubing, pipes, capillary tubes, etc.), and which terminates in an outlet end that at least partially extends into the ionization chamber 850 to discharge the liquid sample therein.

Analytes of interest, which are contained within the sample discharged from the ion source 802, can be ionized within the ionization chamber 850, which is separated from a first vacuum chamber 860 by a curtain plate 804*a* and an orifice plate 804*b* (collectively designated 804) having orifices (e.g., aperture 861) providing fluid communication between the ionization chamber 850 and the first vacuum chamber 860. In this embodiment, orifices in the curtain plate 804*a* and orifice plate 804*b* are sufficiently large to allow the incoming ions to enter the first vacuum chamber 860. By way of example, the orifices (e.g., aperture 861) can be substantially circular with a diameter in a range of about 0.6 mm to about 10 mm.

Although not shown in the schematic of FIG. 8, the MS system 800 can include various other components. For example, the MS system 800 can include a curtain gas supply (not shown) that provides a curtain gas flow (e.g., of $N_2$) adjacent the curtain plate 804*a* to aid in reducing contamination in the high-vacuum downstream vacuum chambers (e.g., by de-clustering and evacuating large neutral particles). In some aspects, a portion of the curtain gas can flow out of the curtain plate aperture 861 into the ionization chamber 850, thereby preventing the entry of droplets and/or neutral molecules through the curtain plate aperture 861.

In various aspects, the ionization chamber 850 can be maintained at a pressure $P_0$, which can be atmospheric pressure or a substantially atmospheric pressure (e.g., about 760 Torr). However, in some embodiments, the ionization chamber 850 can be evacuated to a pressure lower than atmospheric pressure, for example, via a pump (not shown) coupled to the ionization chamber 850.

Initially, ions generated by the ion source 802 can be successively transmitted in the direction indicated by the arrow in FIG. 8 through the upstream ion guides 806, 810, 814 disposed in the differentially-pumped intermediate vacuum chambers 860, 870, 880*a* to result in a narrow and highly focused ion beam (e.g., along the central longitudinal axis of the system 800) for further mass-to-charge ratio (m/z)-based analysis within the high vacuum chamber 880*b* within which the mass spectrometer 818 is disposed.

The upstream ion guides 806, 810, 814 can have a variety of different configurations. By way of non-limiting example, the first ion guide 806 can comprise a set of rods arranged in a dodecapole configuration so as to provide a passageway for the transit of ions through the ion guide 806. An example of such an ion guide is described in U.S. Pat. No. 10,475,633, the teachings of which are incorporated by reference herein in their entirety. More generally, the first ion guide 806 can comprise any number of rods, for example, a plurality of rods maintained in a quadrupole, hexapole, octopole, or dodecapole configuration, or can be formed using a series of stacked rings such that the application of DC and/or RF voltages to one or more of these rods or rings, in a manner known in the art, in combination with gas dynamics can allow the ion guide 806 to focus the ions received through the aperture 861 as they pass through the ion guide 806 for transmission to downstream elements.

As described otherwise herein, operation of the vacuum pumping system can maintain the pressures in the various chambers within a desired range. By way of example, a first positive displacement vacuum pump 820 may be coupled to the first vacuum chamber 860 via an opening or port, for example, so as to apply a negative pressure to the first vacuum chamber 860 to maintain the pressure ($P_1$) in the first vacuum chamber 860 in a range of between about 1 Torr and about 100 Torr, although other pressures can be used for this or for other purposes. In some aspects, the first vacuum chamber 860 may be maintained in a range of about 1 Torr to about 15 Torr, for example, in a range from about 4 Torr to about 8 Torr.

An aperture 871 disposed in an ion lens 808 (also referred to herein as IQ00) that is positioned downstream of the first ion guide 806 allows the passage of ions from the first vacuum chamber 860 into a second downstream vacuum chamber 870 in which another ion guide 810 is positioned. It will be appreciated that the vacuum chambers 860, 870 are therefore in fluid communication through the aperture 871 such that gas may flow therebetween depending, for example, on the differential pressures therebetween. In this embodiment, the aperture 871 in the ion lens 808 is sufficiently large to allow the ions transmitted from the first ion guide 806 to enter the second vacuum chamber 870.

The ion guide 810 can have the same or different configuration as ion guide 808 but may generally be configured to focus the ions received through the aperture 871 to downstream elements, for example, using a combination of electric fields and gas dynamics. As above, a power supply (not shown) can apply RF and/or DC voltage(s) to rods of the ion guide 810 to radially confine and focus the ions as they pass therethrough.

As shown in FIG. 8, the vacuum pumping system may also comprise at least a second positive displacement vacuum pump 830 that may be coupled to the second vacuum chamber 870 (e.g., via an opening or port) so as to enable the application of negative pressure to the second vacuum chamber 870 to maintain the pressure ($P_2$) in the second vacuum chamber 870 within a desired range. In some embodiments, the pressure within the second vacuum chamber 870 is generally maintained at a lower pressure than that of the first vacuum chamber 860 ($P_1$). By way of non-limiting example, the pressure ($P_2$) in the second vacuum chamber 870 may be maintained in a range between about 500 mTorr to about 5 Torr, although other pressures can be used for this or for other purposes.

An ion lens 812 (also referred to as IQ0) separates the second vacuum chamber 870 from the third vacuum chamber 880*a*, within which another ion guide 814 may be disposed. An aperture 881 provided within the ion lens 812 allows the passage of the ions transmitted from the ion guide 810 into the third vacuum chamber 880*a*. It will be appreciated that the vacuum chambers 870, 880*a* are therefore in fluid communication through the aperture 881 such that gas may flow therebetween depending, for example, on the differential pressures. In this embodiment, the aperture 881 in the ion lens 812 is sufficiently large to allow the ions transmitted from the second ion guide 810 to enter the third vacuum chamber 880*a*.

The ion guide 814 can have the same or different configuration as ion guide 810 but may generally be configured to further focus the ions received through the aperture 881 as they are transmitted through an intermediate pressure region prior to transmission to the mass spectrometer 818 through an aperture 891 in the ion lens 816 (also referred to herein as "IQ1"). In some embodiments, the ion guide 814 (also referred to herein as "Q0") can be an RF ion guide and can comprise a quadrupole rod set. As above, a power supply (not shown) can apply RF to rods of the ion guide 814 to radially confine and focus the ions as they pass therethrough.

As shown in FIG. 8, the vacuum pumping system may also comprise at least a first high-vacuum pump 840*a* for maintaining the third vacuum chamber 880*a* containing the ion guide Q0 at an intermediate pressure ($P_3$) between the second vacuum chamber 870 (e.g., at $P_2$) and the fourth vacuum chamber 880*b* (e.g., at $P_4$).

The vacuum pump 840*a* may be any pump known in the art such as a turbomolecular pump, for example, that is generally able to maintain the chamber 880*a* at pressures at least below about 100 mTorr. In some embodiments, the third vacuum chamber 880*a* can be maintained at a pressure between about 3 to 15 mTorr, although other pressures can be used for this or for other purposes. While the positive displacement pumps 820, 830 may not be able to maintain such low pressures alone, the second positive displacement pump 830 may be coupled (e.g., in series) to the pump 840*a* to serve as a backing pump as shown in FIG. 8 to assist in maintaining the reduced pressures of the third vacuum chamber 880*a*.

Ions are transmitted from the ion guide 814 into the fourth vacuum chamber 880*b* containing a mass spectrometer 818, which typically operates at very low pressures (high vacuum) to reduce the chance of ions colliding with other molecules (e.g., gas molecules) within the one or more mass analyzers to enable the ions' characterization according to their mass-to-charge ratios (m/z). By way of non-limiting example, in one embodiment, the mass spectrometer 818 may comprise a detector, as well as two quadrupole mass analyzers (e.g., Q1, Q3) with a collision cell (e.g., q2) located between them. It will be apparent to those skilled in the art that the mass spectrometer 818 employed could take the form of a quadrupole mass spectrometer, triple quadrupole mass spectrometer, time-of-flight mass spectrometer, FT-ICR mass spectrometer, or Orbitrap® mass spectrometer, all by way of non-limiting example.

As shown in FIG. 8, the vacuum pumping system may also comprise a second high-vacuum pump 840*b* for maintaining the fourth vacuum chamber 880*b* containing the mass spectrometer 818 at a pressure ($P_4$) of $1\times10^{-4}$ Torr or lower (e.g., about $5\times10^{-5}$ Torr), though other pressures can be used for this or for other purposes. As shown, the second positive displacement pump 830 may be coupled (e.g., in series) to the second high-vacuum pump 840*b* to serve as a backing pump to assist in maintaining the pressure ($P_4$) in the desired range. That is, in some embodiments, the second positive displacement pump 830 may serve as a backing pump for two turbomolecular pumps 840*a,b* operating in parallel to maintain two chambers 880*a,b* at differential pressures.

It will be appreciated that not only are adjacent vacuum chambers (e.g., vacuum chambers 870, 880*a*) fluidly coupled through an aperture (e.g., aperture 881), but each of the vacuum chambers in the example MS system 800 are indirectly coupled to one another. In this manner, depending on the relative pressures between the various chambers, it will be apparent in light of the present teachings that the operation (or failure) of one pump (e.g., pump 820) may affect the pressure within and gas flows into or out of a vacuum chamber even if not directly coupled thereto. By way of non-limiting example, if both pumps 820 and 830 were turned off in an uncoordinated manner, a flow of gas between the downstream chambers could be generated due to the pressure differential between each chamber. The synchronized control of the parallel pumps 820, 830 as discussed otherwise herein (e.g., with reference to FIGS. 3-7), however, may be effective to prevent contamination of the MS system 800 due to backflow from the uncoordinated operation of the one or more of the pumps 820, 830. Such contamination becomes especially costly in mass spectrometry systems, as it would require significant cleaning costs and instrument downtime. Moreover, the management unit 890 may be further configured to implement corrective actions on the turbomolecular vacuum pumps 840*a,b* in case of the faulty or un-synchronized operation of the positive displacement vacuum pumps 820, 830. For instance, the management unit 890 may be further configured to switch off the turbomolecular vacuum pumps 840*a,b* in case the detected value of one or more identified parameter(s) of one or more of the positive displacement vacuum pumps 820, 830 exceeds the corresponding threshold value or the detected condition of one or more identified parameter(s) is not consistent with the corresponding threshold condition.

Figure 9:
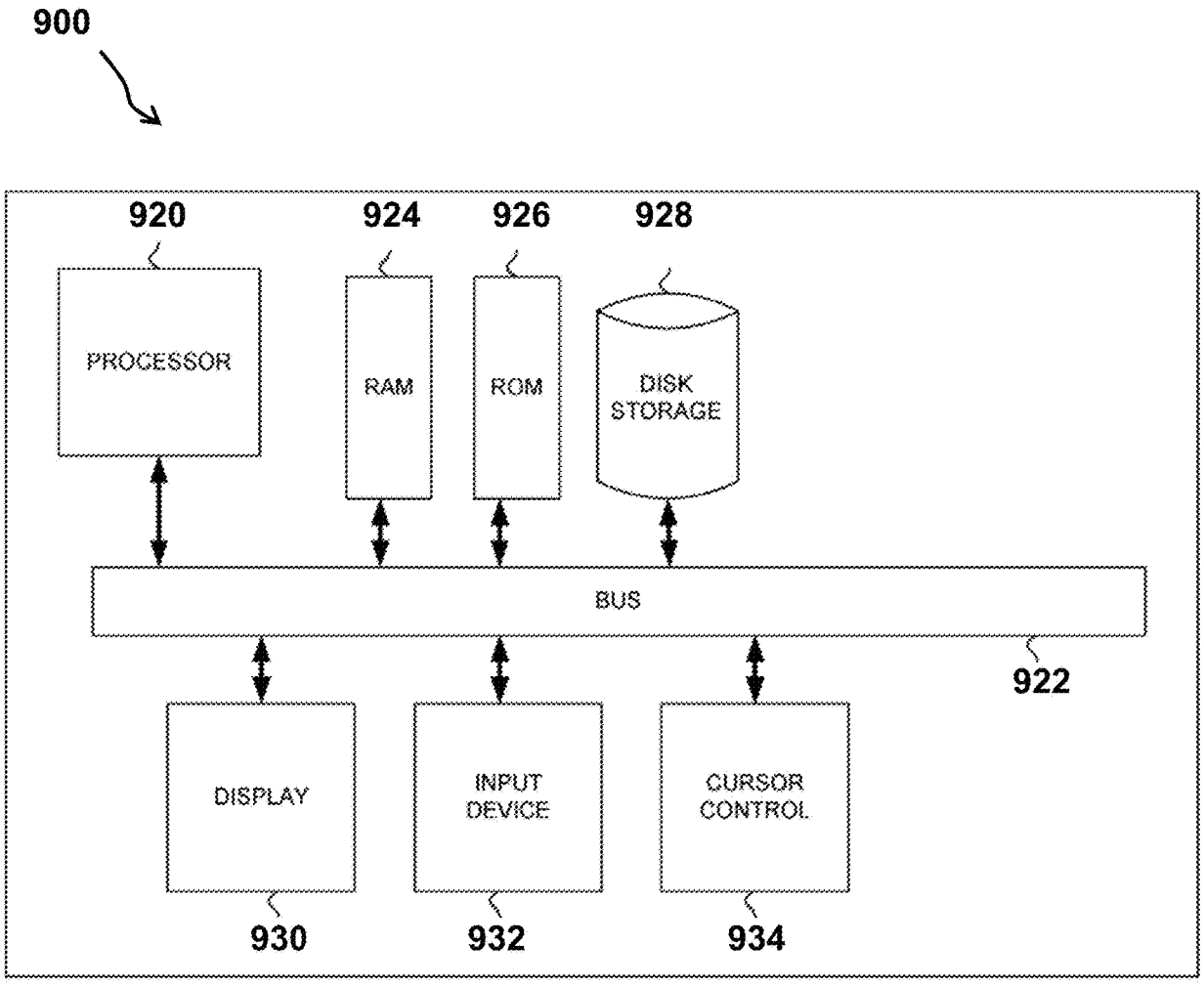
FIG. 9 is a block diagram that illustrates a computer system, upon which embodiments of the present teachings may be implemented in accordance with various aspects of the present disclosure.

FIG. 9 is a block diagram that illustrates a computer system 900 (or controller), upon which embodiments of the present teachings may be implemented to prevent a backflow condition from at least one of the pumps 820, 830 into the vacuum chambers 860, 870 of FIG. 8. For example, the computer system 900 may be or include, or otherwise be associated with, the management unit 90 described above. The computer system 900 includes a bus 922 or other communication mechanism for communicating information, and a processor 920 coupled with the bus 922 for processing information. The computer system 900 also includes a memory 924, which can be a random access memory (RAM) or other dynamic storage device, coupled to the bus 922 for storing instructions to be executed by the processor 920. The memory 924 also may be used for storing temporary variables or other intermediate information during execution of instructions to be executed by the processor 920. The computer system 900 further includes a read only memory (ROM) 926 or other static storage device coupled to the bus 922 for storing static information and instructions for the processor 920. A storage device 928, such as a magnetic disk or optical disk, is provided and coupled to the bus 922 for storing information and instructions.

The computer system 900 may be coupled via the bus 922 to a display 930, such as a cathode ray tube (CRT) or liquid crystal display (LCD), for displaying information to a computer user. An input device 932, including alphanumeric and other keys, is coupled to the bus 922 for communicating information and command selections to the processor 920. Another type of user input device is a cursor control 934, such as a mouse, a trackball or cursor direction keys for communicating direction information and command selections to the processor 920 and for controlling cursor movement on the display 930. This input device typically has two degrees of freedom in two axes, a first axis (i.e., x) and a second axis (i.e., y), that allows the device to specify positions in a plane.

A computer system 900 can perform the present teachings. Consistent with certain implementations of the present teachings, results are provided by computer system 900 in response to processor 920 executing one or more sequences of one or more instructions contained in memory 924. Such instructions may be read into memory 924 from another computer-readable medium, such as storage device 928. Execution of the sequences of instructions contained in memory 924 causes processor 920 to perform the process described herein. Alternatively, hard-wired circuitry may be used in place of or in combination with software instructions to implement the present teachings. Thus, implementations of the present teachings are not limited to any specific combination of hardware circuitry and software. For example, the present teachings may be performed by a system that includes one or more distinct software modules for synchronizing the operation of the pumps to prevent a backflow condition in accordance with various embodiments.

In various embodiments, the computer system 900 can be connected to one or more other computer systems, like computer system 900, across a network to form a networked system. The network can include a private network or a public network such as the Internet. In the networked system, one or more computer systems can store and serve the data to other computer systems. The one or more computer systems that store and serve the data can be referred to as servers or the cloud, in a cloud computing scenario. The one or more computer systems can include one or more web servers, for example. The other computer systems that send and receive data to and from the servers or the cloud can be referred to as client or cloud devices, for example.

The term "computer-readable medium" as used herein refers to any media that participates in providing instructions to the processor 920 for execution. Such a medium may take many forms, including but not limited to, non-volatile media, volatile media, and transmission media. Non-volatile media includes, for example, optical or magnetic disks, such as the storage device 928. Volatile media includes dynamic memory, such as the memory 924. Transmission media includes coaxial cables, copper wire, and fiber optics, including the wires that comprise the bus 922.

Common forms of computer-readable media or computer program products include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to the processor 920 for execution. For example, the instructions may initially be carried on the magnetic disk of a remote computer. The remote computer can load the instructions into its dynamic memory and send the instructions over a telephone line using a modem. A modem local to the computer system 900 can receive the data on the telephone line and use an infra-red transmitter to convert the data to an infra-red signal. An infra-red detector coupled to the bus 922 can receive the data carried in the infra-red signal and place the data on the bus 922. The bus 922 carries the data to the memory 924, from which the processor 920 retrieves and executes the instructions. The instructions received by the memory 924 may optionally be stored on the storage device 928 either before or after execution by the processor 920.

The descriptions herein of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software, though the present teachings may be implemented as a combination of hardware and software or in hardware alone. The present teachings may be implemented with both object-oriented and non-object-oriented programming systems.

It will be evident that the foregoing description is for the purpose of illustration only, and not for the purpose of limitation—the invention being defined by the claims.

What is claimed is:

1. A vacuum pumping system, comprising:

a plurality of positive displacement vacuum pumps, comprising at least two positive displacement vacuum pumps separately connected to at least one vacuum chamber; and a management unit configured to control respective operations of the positive displacement vacuum pumps individually, and to perform an operation comprising:

detecting, for each of the positive displacement vacuum pumps individually, a value or a condition of one or more operating parameters related to a risk of contamination of the vacuum pumping system by one or more of the positive displacement vacuum pumps;

comparing, for each of the positive displacement vacuum pumps individually, the detected values or conditions of the one or more operating parameters with corresponding threshold values or ranges of values or threshold conditions;

based on the comparing, determining that at least one of the positive displacement pumps is a malfunctioning pump, by determining that the detected value of at least one of the one or more operating parameters of the malfunctioning pump deviates from the corresponding threshold value or range of values, or the detected condition of at least one of the one or more operating parameters of the malfunctioning pump is not consistent with the corresponding threshold condition; and automatically performing a shutdown procedure on the malfunctioning pump and one or more of the other positive displacement vacuum pumps in a synchronized manner effective to avoid a backflow-inducing pressure condition in the vacuum pumping system that induces a backflow of contaminant-bearing gas from the malfunctioning pump into the at least one vacuum chamber.

2. The vacuum pumping system according to claim 1, wherein the one or more operating parameters for each positive displacement vacuum pump are selected from the group consisting of: a pump frequency; a power used by the positive displacement vacuum pump; a current used by the positive displacement vacuum pump; a voltage used by the positive displacement vacuum pump; a temperature of one or more components of the positive displacement vacuum pump; a pressure in the at least one vacuum chamber; and a flow rate through a connection between the positive displacement vacuum pump and at least one vacuum chamber.

3. The vacuum pumping system according to claim 1, wherein the management unit is configured to perform the shutdown procedure according to at least one of:

performing the shutdown procedure on the malfunctioning pump and two or more of the other positive displacement vacuum pumps;

performing the shutdown procedure on the malfunctioning pump and all of the other positive displacement vacuum pumps;

triggering an alarm.

4. The vacuum pumping system according to claim 1, wherein the management unit is configured to perform the detecting and the comparing according to at least one of:

detecting the value or the condition of the one or more operating parameters, and comparing the detected values or conditions with the corresponding threshold values or ranges of values or threshold conditions, for each of the positive displacement vacuum pumps simultaneously;

detecting the value or the condition of the one or more operating parameters, and comparing the detected values or conditions with the corresponding threshold values or ranges of values or threshold conditions, for each of the positive displacement vacuum pumps according to a predetermined order;

detecting the value or the condition of the one or more operating parameters, and comparing the detected values or conditions with the corresponding threshold values or ranges of values or threshold conditions, for each of the positive displacement vacuum pumps continuously;

detecting the value or the condition of the one or more operating parameters, and comparing the detected values or conditions with the corresponding threshold values or ranges of values or threshold conditions, for each of the positive displacement vacuum pumps at predetermined time intervals.

5. The vacuum pumping system according to claim 1, wherein at least one of the positive displacement vacuum pumps is an oil lubricated vacuum pump, and the management unit is configured to prevent oil from the oil lubricated vacuum pump from backflowing into the vacuum pumping system in response to determining that the oil lubricated vacuum pump is a malfunctioning pump.

6. The vacuum pumping system according claim 5, wherein the oil lubricated vacuum pump is a rotary vane vacuum pump, and the rotary vane vacuum pump comprises an outer housing, receiving a pump body within which a stator surrounding and defining a cylindrical pumping chamber is defined, in which pumping chamber a cylindrical rotor is accommodated and eccentrically located with respect to an axis of the pumping chamber, one or more radially movable radial vanes being mounted on the rotor and kept against the wall of the pumping chamber, and an amount of oil being introduced into the outer casing for acting as a coolant and lubricating fluid.

7. The vacuum pumping system according to claim 1, wherein the performing of the shutdown procedure comprises at least one of:

adjusting a pump frequency of at least one of the positive displacement vacuum pumps relative to a pump frequency of at least one of the other positive displacement vacuum pumps to avoid the backflow-inducing pressure condition;

adjusting respective pump frequencies of the malfunctioning pump and one or more of the other positive displacement vacuum pumps relative to each other to avoid the backflow-inducing pressure condition.

8. The vacuum pumping system according to claim 1, wherein the at least one vacuum chamber comprises a common vacuum chamber to which the positive displacement vacuum pumps are separately connected.

9. The vacuum pumping system according to claim 1, wherein:

the at least one vacuum chamber comprises a plurality of vacuum chambers comprising at least a first vacuum chamber and a second vacuum chamber;

the first vacuum chamber and the second vacuum chamber are in mutual fluid communication between the first vacuum chamber and the second vacuum chamber;

the plurality of positive displacement vacuum pumps comprises at least a first positive displacement vacuum pump and a second positive displacement vacuum pump; and the first positive displacement pump is connected to the first vacuum chamber separately from the second positive displacement pump and the second positive displacement pump is connected to the second vacuum chamber separately from the first positive displacement pump.

10. The vacuum pumping system according to claim 9, wherein the management unit is configured to control the first positive displacement pump to maintain the first vacuum chamber at a first operating pressure and the second positive displacement pump to maintain the second vacuum chamber at a second operating pressure.

11. An analytical instrument for processing ions, the analytical instrument comprising:

a plurality of vacuum chambers comprising at least a first vacuum chamber and a second vacuum chamber, wherein the second vacuum chamber is in fluid communication with the first vacuum chamber and configured to receive ions therefrom;

one or more ion guides positioned in one or more of the vacuum chambers; and the vacuum pumping system according to claim 1, wherein:

the at least one vacuum chamber corresponds to the plurality of vacuum chambers;

the at least two positive pumps comprise a first positive displacement pump and a second positive displacement pump;

the first positive displacement pump is connected to the first vacuum chamber separately from the second positive displacement pump and the second positive displacement pump is connected to the second vacuum chamber separately from the first positive displacement pump;

the management unit is configured to control the first positive displacement pump to maintain the first vacuum chamber at a first operating pressure and the second positive displacement pump to maintain the second vacuum chamber at a second operating pressure different from the first operating pressure; and in response to determining that the malfunctioning pump is the first positive displacement pump or the second positive displacement pump, the management unit is configured to perform the shutdown procedure on at least the first positive displacement pump and the second positive displacement pump to avoid the backflow-inducing pressure condition occurring in one or both of the first vacuum chamber and the second vacuum chamber.

12. The analytical instrument according to claim 11, wherein:

the plurality of vacuum chambers comprises at least a third vacuum chamber;

the vacuum pumping system comprises a high-vacuum pump connected to the third vacuum chamber;

the management unit is configured to control the high-vacuum pump to maintain the third vacuum chamber at a third operating pressure lower than the first operating pressure and the second operating pressure; and as part of the performing of the shutdown procedure, the management unit is configured to switch off the high-vacuum pump.

13. The analytical instrument according to claim 11, comprising at least one of:

an ionization chamber in fluid communication with at least one of the vacuum chambers;

a collision cell positioned in one of the vacuum chambers;

a mass analyzer positioned in one of the vacuum chambers.

14. The analytical instrument according to claim 11, wherein:

the management unit is configured to control processing ions in the first vacuum chamber and the second vacuum chamber; and the management unit is configured to control the detecting, the comparing, the determining that at least one of the positive displacement pumps is a malfunctioning pump, and at least an initiation of the performing of the shutdown procedure while processing the ions.

15. The vacuum pumping system according to claim 1, wherein:

the management unit is configured to operate the plurality of positive displacement pumps to evacuate the at least one vacuum chamber; and the management unit is configured to control the detecting, the comparing, the determining that at least one of the positive displacement pumps is a malfunctioning pump, and at least an initiation of the performing of the shutdown procedure while the positive displacement pumps are evacuating the at least one vacuum chamber.

16. A method of operating a vacuum pumping system, the vacuum pumping system comprising a plurality of positive displacement vacuum pumps, the plurality of positive displacement vacuum pumps comprising at least two positive displacement vacuum pumps separately connected to at least one vacuum chamber, the method comprising:

operating and controlling the positive displacement vacuum pumps individually to evacuate the at least one vacuum chamber; and operating a management unit to perform or control:

detecting, for each of the positive displacement vacuum pumps individually, a value or a condition of one or more operating parameters related to a risk of contamination of the vacuum pumping system by one or more of the positive displacement vacuum pumps;

comparing, for each of the positive displacement vacuum pumps individually, the detected values or conditions of the one or more operating parameters with corresponding threshold values or ranges of values or threshold conditions;

based on the comparing, determining that at least one of the positive displacement pumps is a malfunctioning pump, by determining that the detected value of at least one of the one or more operating parameters of the malfunctioning pump deviates from the corresponding threshold value or range of values, or the detected condition of at least one of the one or more operating parameters of the malfunctioning pump is not consistent with the corresponding threshold condition; and automatically performing a shutdown procedure on the malfunctioning pump and one or more of the other positive displacement vacuum pumps in a synchronized manner effective to avoid a backflow-inducing pressure condition in the vacuum pumping system that induces a backflow of contaminant-bearing gas from the malfunctioning pump into the at least one vacuum chamber.

17. The method according to claim 16, wherein the one or more operating parameters for each positive displacement vacuum pump are selected from the group consisting of: a pump frequency; a power used by the positive displacement vacuum pump; a current used by the positive displacement vacuum pump; a voltage used by the positive displacement vacuum pump; a temperature of one or more components of the positive displacement vacuum pump; a pressure in the at least one vacuum chamber; and a flow rate through a connection between the positive displacement vacuum pump and at least one vacuum chamber.

18. The method according to claim 16, wherein:

the at least one vacuum chamber comprises a first vacuum chamber for containing a first ion guide configured to receive a plurality of ions generated by an ion source of a mass spectrometry system, and a second vacuum chamber for containing a second ion guide configured to receive at least a portion of the ions transmitted from the first ion guide; and the plurality of positive displacement vacuum pumps comprises a first positive displacement pump configured to maintain the first vacuum chamber at a first operating pressure, and a second positive displacement pump configured to maintain the second vacuum chamber at a second operating pressure.

19. The method according to claim 16, wherein the detecting, the comparing, the determining that at least one of the positive displacement pumps is a malfunctioning pump, and at least an initiation of the performing of the shutdown procedure is done during the operating and controlling of the positive displacement vacuum pumps individually to evacuate the at least one vacuum chamber.

20. The method according to claim 18, comprising processing ions in the first vacuum chamber and the second vacuum chamber, wherein the detecting, the comparing, the determining that at least one of the positive displacement pumps is a malfunctioning pump, and at least an initiation of the performing of the shutdown procedure is done during the processing of the ions.

* * * * *